US008833229B2

(12) United States Patent
Baxter et al.

(10) Patent No.: US 8,833,229 B2
(45) Date of Patent: Sep. 16, 2014

(54) CERAMIC ARMOUR ELEMENT FOR USE IN ARMOUR

(75) Inventors: Andrew George Baxter, Salisbury (GB); Ross Adam Buchanan Jones, Salisbury (GB); Thomas Paul Stuart, Salisbury (GB)

(73) Assignee: The Secretary of State for Defence (GB)

( * ) Notice: Subject to any disclaimer, the term of this patent is extended or adjusted under 35 U.S.C. 154(b) by 615 days.

(21) Appl. No.: 11/887,058

(22) PCT Filed: Mar. 29, 2006

(86) PCT No.: PCT/GB2006/001150

§ 371 (c)(1),
(2), (4) Date: May 6, 2008

(87) PCT Pub. No.: WO2006/103431

PCT Pub. Date: Oct. 5, 2006

(65) Prior Publication Data

US 2009/0078109 A1 Mar. 26, 2009

(30) Foreign Application Priority Data

Mar. 30, 2005 (GB) ..... 0506360.7

(51) Int. Cl.
*F41H 5/00* (2006.01)
*F41H 5/04* (2006.01)

(52) U.S. Cl.
CPC ..... *F41H 5/0435* (2013.01); *F41H 5/0492* (2013.01)
USPC ..... 89/36.01; 89/36.02

(58) Field of Classification Search
CPC ..... F41H 5/00; F41H 5/013; F41H 5/02
USPC ..... 89/36.01, 36.02
See application file for complete search history.

(56) References Cited

U.S. PATENT DOCUMENTS

| | | | | | |
|---|---|---|---|---|---|
| 1,694,665 | A | * | 12/1928 | Parker | 52/591.2 |
| 2,836,055 | A | | 5/1958 | Shuman | |
| 3,523,057 | A | | 8/1970 | Buck | |
| 3,627,861 | A | * | 12/1971 | Timke | 264/680 |
| 3,746,458 | A | * | 7/1973 | Allocca | 404/37 |
| 4,301,634 | A | * | 11/1981 | Shore et al. | 52/389 |
| 4,534,266 | A | * | 8/1985 | Huet | 89/36.02 |
| 4,760,611 | A | | 8/1988 | Huet | |
| 5,131,314 | A | * | 7/1992 | Hansen et al. | 89/36.02 |

(Continued)

FOREIGN PATENT DOCUMENTS

| | | |
|---|---|---|
| DE | 1952759 | 10/1969 |
| DE | 3940624 | 12/1989 |

(Continued)

*Primary Examiner* — Michelle R Clement
(74) *Attorney, Agent, or Firm* — Dean W. Russell; Kristin M. Crall; Kilpatrick Townsend & Stockton LLP

(57) ABSTRACT

The invention concerns an armor panel to provide protection from projectiles. The present invention relates to an armor panel comprising a layer of hexagonal ceramic armor elements (10) having a spacing means in the form of lugs (12, 14, 16, 18, 20, 22) which are on the side of the ceramic armor element 10 and arranged to co-operate with adjacent ceramic armor elements (100, 200, 300, 400, 500, 600) and form a bond line in the space (48) between elements.

19 Claims, 3 Drawing Sheets

(56) References Cited

U.S. PATENT DOCUMENTS

| | | | | |
|---|---|---|---|---|
| 5,267,810 | A * | 12/1993 | Johnson | 404/41 |
| 5,738,925 | A | 4/1998 | Chaput | |
| 6,532,857 | B1 * | 3/2003 | Shih et al. | 89/36.02 |
| 6,601,497 | B2 * | 8/2003 | Ghiorse et al. | 89/36.02 |
| 6,607,691 | B1 * | 8/2003 | Rivola | 264/678 |
| 2002/0178900 | A1 | 12/2002 | Ghiorse et al. | |
| 2003/0150321 | A1 * | 8/2003 | Lucuta et al. | 89/36.02 |

FOREIGN PATENT DOCUMENTS

| | | | |
|---|---|---|---|
| DE | 3122367 | C1 | 12/1994 |
| EP | 0499812 | A1 | 8/1992 |
| EP | 0843149 | | 5/1998 |
| EP | 1128154 | A2 | 8/2001 |
| EP | 1363101 | A1 | 11/2003 |
| FR | 2526535 | A1 | 11/1983 |
| GB | 2032485 | | 5/1980 |
| GB | 2036267 | | 6/1980 |
| GB | 2147377 | A | 5/1985 |
| GB | 2147977 | | 5/1985 |
| GB | 2149482 | | 6/1985 |
| GB | 2279445 | A | 1/1995 |
| GB | 2377006 | | 12/2002 |
| RU | 2193151 | C2 | 11/2002 |
| WO | WO98/37376 | | 8/1998 |
| WO | 0047944 | A | 8/2000 |

* cited by examiner

CERAMIC ARMOUR ELEMENT FOR USE IN ARMOUR

CROSS REFERENCE TO RELATED APPLICATIONS

This application is the U.S. national phase of International Application No. PCT/GB2006/001150 filed on Mar. 29, 2006 and published in English on Oct. 5, 2006 as International Publication No. WO 2006/103431 A1, which application claims priority to Great Britain Patent Application No. 0506360.7 filed on Mar. 30, 2005, the contents of which are incorporated herein by reference.

The invention concerns an armor panel. More particularly, the invention relates to panels of armor that provide protection from projectiles.

Ceramic armor comprising of panels, which are assembled from individual ceramic elements, are known in the art to provide protection from projectiles. Ceramic armor panels in the prior art are comprised of ceramic elements having a basic element shape assembled in an array. Ceramics are very hard and physically stable, making them highly resistant to melting, bending, stretching, corrosion or wear. Ceramic is known, for example, to be used in armor, insulators and prosthetic joints and may be made from aluminium oxide (alumina), for example. The basic ceramic element shape for armor may be a cylinder, sphere or tile (for example, square or hexagonal shape).

Absorption of momentum and kinetic energy is important in ceramic armor for two reasons. Firstly, to prevent penetration of the armor by a projectile and secondly, to ensure that the momentum and kinetic energy is absorbed in such a manner that the functionality of the armor is not compromised for subsequent impacts. British Patent Application GB 2149482A describes use of a plate or film of synthetic material for absorbing energy in the form of shock waves in a projectile-proof material. The prior art has the disadvantage that material to absorb energy must be added separately to the panel.

In British Patent Application GB2147377A elements are packed together in a mosaic arrangement and bound to a backing plate by an adhesive. An adhesive is distributed between the embedded elements in European Patent EP0843149B1. In order for adhesive to flow evenly and be distributed evenly in a packed arrangement it is necessary to have spacing between the elements. Elements that are touching enable energy in the form of shock waves to propagate through adjacent elements. That is, energy from a projectile is transferred to an element in the panel and further transferred between touching elements. Where elements are touching energy propagates through the panel as if the panel was one large element.

European Patent EP0843149B1 has the disadvantage that there can be a relatively large vacancy between elements which is not filled with adhesive or ceramic, particularly where spheres are used as the prior art element shape. This vacancy may allow a projectile to penetrate the armor at the space between elements. This disadvantage occurs because of the segment geometry and irregular adhesive distribution within the frame used to assemble the panel. U.S. Pat. No. 3,523,057 attempts to overcome the problem of the vacancy between elements by filling interstitial voids with smaller spherical spheres. This technique has the disadvantage that the panel does not offer a corresponding increase in performance associated with the increase in armor weight due to the addition of small spherical spheres.

Prior art panels, such as those in European Patent EP 0843149B1 are comprised of elements having a shaped lower face, which enables adhesive flow around the under side of the element. Having a shaped lower face on the element has the disadvantage that energy is dissipated over an area of the backing plate larger than the surface area of the transverse cross section of the element. Where the backing plate is made from glass fibre reinforced plastic (GFRP) the backing plate fails in a progressive manner, with each fibre failing under compression or tension as the profile of the shaped lower face of the element bonded to the adhesive distorts the fibre lattice of the backing plate. The greater the radius of the shaped lower face of the element, the more pronounced the effect over a larger surface of the backing plate.

Large tile designs, such as those in British Patent Application GB214977A have poor capability for multi-hit purposes. Large tiles are usually destroyed when struck by a projectile and energy is transferred to adjacent tiles, potentially causing fractures in these tiles. Energy is also transmitted through the thickness of the tile, and if bonded to a backing plate, can induce de-bonding from the backing plate of the impacted and adjacent tiles. Complete destruction of tiles leaves a large area of the panel having no ceramic layer and thus reduced protection should the panel be struck again in the same vicinity.

The present invention relates to an armor panel comprising a layer of ceramic armor elements and spacing means characterised in that the spacing means comprises a lug on a side of a ceramic armor element arranged to co-operate with an adjacent ceramic armor element. An element is a 3 dimensional object having two faces substantially opposed to each other and having at least three sides joining the faces. Alternatively, the two faces may be circular and joined by one side. A lug is a protrusion from a side of a ceramic element. The spacing means provides substantially uniform spacing for formation of a bond line between sides of adjacent ceramic armor elements in the panel. A bond line is a layer of material between sides of adjacent ceramic armor elements.

In the present invention, the material used for the bond line is an adhesive.

An embodiment of the invention utilises a hexagonal element shape which incorporates a lug on each side of the hexagonal element. When the ceramic armor element is rotated 60° through the axis of symmetry of the hexagonal transverse cross section of the ceramic armor element, the position of the lugs on the ceramic amour element is substantially the same. The lugs may be an integral part of the element moulded as part of the element. This element shape with integral lugs has the advantage that assembly of ceramic armor elements in the panel is simplified. When a panel is being assembled, elements are configured to tessellate. The hexagonal symmetry of the elements means that elements can be fitted into the array with minimal effort required for proper orientation to ensure tessellation.

Moulded lugs on the sides of the elements provide space for a controlled uniform bond line between elements, equivalent to the width of the lug. A uniform bond line between elements limits energy transfer to adjacent elements by providing a means for energy absorption. Conventional spherical arrays do not have the uniform bond line achieved by the use of an element with moulded lugs. In the invention, because of the reduction in energy transfer between elements, there is a high probability that ceramic armor elements in the panel remain intact and adjacent ceramic armor elements remain bonded to the backing plate. The panel's inherent shock absorbing properties has the advantage that a plate or film of synthetic material for shock absorbing does not have to be added separately, as in, for example GB 2149482A.

The invention has the further advantage that the lugs separate adjacent elements evenly, thus the requirement of an independent spacing means between each element can be dispensed with. The lugs on the element and the spacing provided between elements facilitates in-plane adhesive infusion and allow for adhesive to be distributed evenly between the elements without any voids. The element shape has the advantage that there is no need for the addition of extra material to fill interstitial voids between elements, as for example the small spheres in U.S. Pat. No. 3,523,057.

Weight is an important consideration in armor because it affects the mobility of the wearer/user. The mass of the panel comprising the hexagonal elements has the same mass as equivalent prior art panels, thus maintaining overall pack weight. Evaluation of a panel according to the invention against an equivalent panel in the prior art shows an improvement in ballistic protection. This has the advantage that an increased level of protection is achieved whilst maintaining the same overall pack weight as a panel in the prior art.

In a preferred embodiment of the invention, the element has a flat lower face. This restricts adhesive flow around the under side of the element. The flat lower face produces an advantage in the mode of failure of the panel. The flat lower face cuts through the glass fibres of the backing plate instead of distorting the fibre lattice in the backing plate. Distortion of the fibre lattice compromises the integrity of the backing plate. Cutting through the backing plate avoids the disadvantages of elements with a shaped lower face, as in European Patent EP 0843149B. Additionally, having lugs on the element provides a preferential plane of movement for the damaged element to move through the array.

The advantage of having a flat lower face on the element, which maintains integrity of the backing plate, combined with the advantage of the inherent shock absorbing properties of the armor panel comprised of hexagonal elements, produces a further advantage in that the multi-hit performance of the armor panel is increased as more of the panel and backing plate remain intact for subsequent impact from projectiles.

With reference to the figures, the invention is described:

Figure 3:
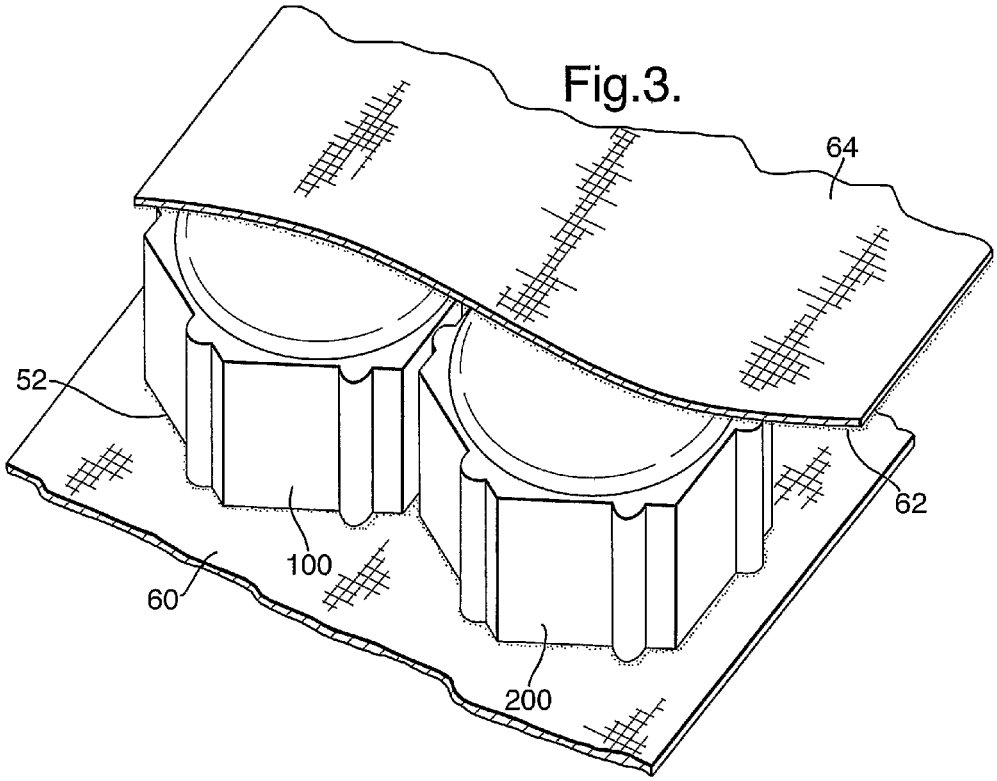
Figure 2:
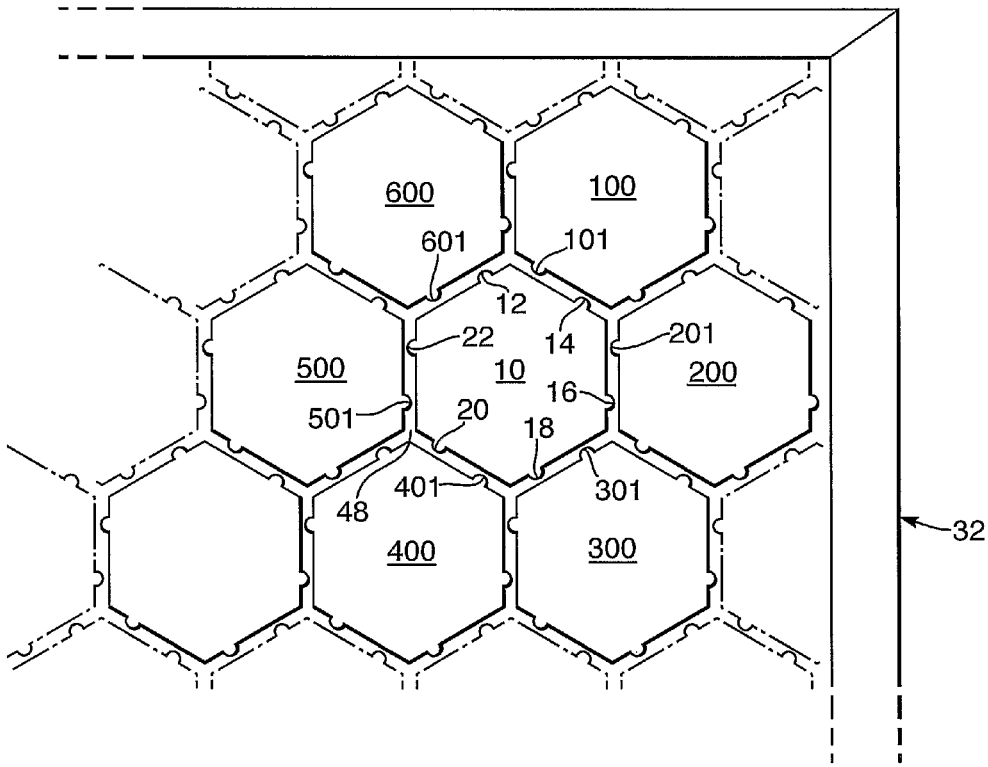
FIG. 2 is a diagram of an array of hexagonal ceramic armor elements
Figure 2A:
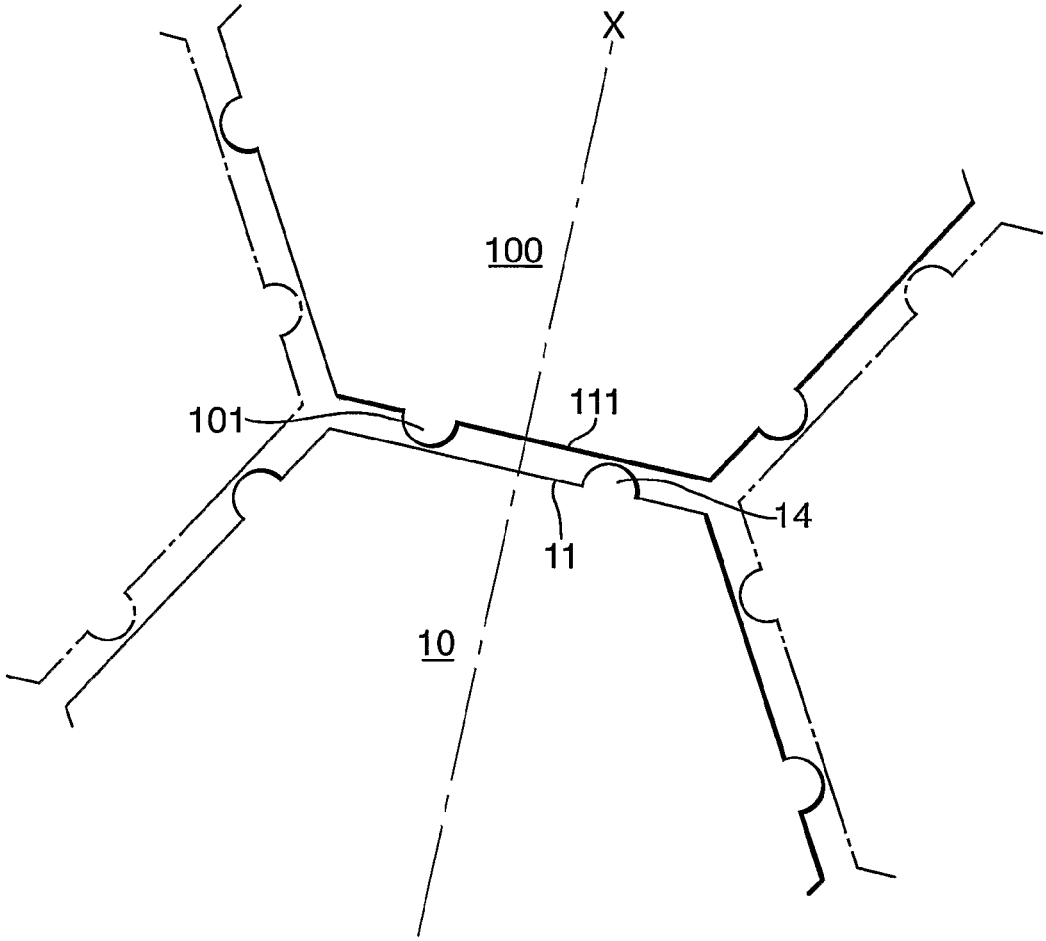

FIG. 2*a* is a diagram of detail of a section of the array showing the co-operation of two elements FIG. 3 is a cut away view of the interior of an armor panel utilising the hexagonal array of FIG. 2.

Figure 1:
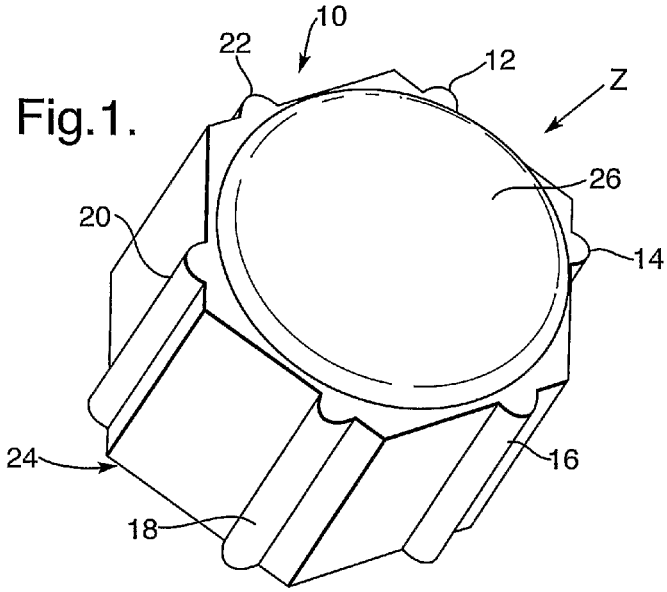
FIG. 1 is a perspective view of a ceramic armor element of the invention

FIG. 1 shows a ceramic armor element 10. The ceramic armor element 10 is of hexagonal cross-sectional shape when looking at the element in the direction indicated by Z. The ceramic armor element 10 has lugs 12, 14, 16, 18, 20, 22 on each side of the ceramic armor element. The element has a flat lower face 24 and a convex upper face 26. The convex upper face acts to dissipate energy from initial impact of the projectile over a greater area than if the element had a flat upper face.

FIG. 2 shows an array of hexagonal ceramic armor elements including element 10 and identical elements 100, 200, 300, 400, 500, 600. The hexagonal array is arranged such that the lugs 12, 14, 16, 18, 20, 22 on ceramic armor element 10 are co-operating with adjacent ceramic armor elements 100, 200, 300, 400, 500, 600. Lugs 101, 201, 301, 401, 501, 601 on adjacent elements 100, 200, 300, 400, 500, 600 are arranged to be on the opposing half of the sides of the adjacent ceramic armor elements 100, 200, 300, 400, 500, 600 from ceramic armor element 10. There is a continuous space 48 in the entire array of hexagonal elements between the sides of the elements allowing for adhesive flow and ingress and formation of a layer of adhesive between the sides of elements.

FIG. 2*a* shows a detail of a section of the array of hexagonal elements showing the co-operation of two elements. Here the line X through the centre of the sides 11 and 111 defines the left-hand halves and the right-hand halves of the sides 11 and 111. From the perspective of ceramic armor element 10, ceramic armor element 10 has a lug 14 on the right-hand half of the side 11 co-operating with the opposing lugless left-hand half of the adjacent ceramic armor element 100. From the perspective of the ceramic armor element 100 ceramic armor element 100 has a lug 101 on the right-hand half of side 111, co-operating with the opposing lugless left-hand half of adjacent element 10.

A number of ceramic armor elements are assembled to co-operate as in FIG. 2*a* to form an entire panel in a close packed hexagonal arrangement as in FIG. 2. A confinement frame 32 is used to keep the individual ceramic armor elements in position while being arranged. In fabrication, when the hexagonal array is completed to form an entire panel in the confinement frame 32, additional adhesive (shown as 62 in FIG. 3) is poured over the panel. The space between the elements 48 facilitates adhesive ingress and results in a bond line between elements. When complete, the panel is partially cured to enable easier handling. The confinement frame 32 is removed after fabrication.

A standard panel as described above contains fixing points to fix the panel to the article to be protected. Panels are assembled to include fixing elements (not shown). Fixing elements are essentially modified steel hexagons having the same dimensions as a ceramic armor element, adapted to facilitate a bolt and adapted to enable lugs of adjacent elements to co-operate with the fixing element. Fixing elements are incorporated into the panel at any position, the position being determined prior to assembly of the panels.

FIG. 3 shows a cut away view of the interior of the armor panel of FIG. 2. The panel consists of a backing plate 60 with ceramic armor elements 100 and 200 adhered to the backing plate 60 by a layer of adhesive 52. The backing plate material is GFRP (glass fibre reinforced plastic). The adhesive used to bond the ceramic to the backing plate 52 and that has been poured over the ceramic armor elements 62 to form the bond line can be the same or different. An example of suitable adhesive for the purposes of panel assembly would be toughened epoxy or toughened epoxy resin. The properties of the adhesive should be at least one and preferably all of the following:

- To offer a high quality bond to both backing plate and ceramic.
- Have a viscosity sufficient to enable the adhesive to be free flowing, ensuing no voids are present between the ceramic armor elements.
- Cures to a consistency of hard rubber or thermosetting compound.
- Requires only a room temperature cure or a moderate post cure at no greater than 50° C.

When set, the panel (with the confinement frame 32 removed) is encapsulated in an aramid and/or glass reinforced fibre envelope 64.

The invention claimed is:

1. An armor panel comprising:

(1) a tessellated array of moulded ceramic armor elements formed of a material that provides multi-hit ballistic protection, in which each ceramic armor element comprises (a) two substantially opposed faces, (b) at least three sides, and (c) each side comprising a single integrally moulded spacing lug that is offset from a longitudinal center-line extending between the two opposed faces of the element, wherein the ceramic armor element possesses a degree of rotational symmetry such that each spacing lug contacts a side of an adjacent ceramic armor element in the tessellated array but does not contact a spacing lug of the adjacent ceramic armor element to provide a substantially uniform spacing for a bond line between adjacent ceramic armor elements, (2) one or more fixing elements that mount the armor panel on an article to be protected, wherein the one or more fixing elements comprises a modified armour element adapted to receive a securing component.

2. An armor panel as claimed in claim 1 wherein the at least one lug on each side of a first of the ceramic armor elements is arranged to be entirely on one half of each side of the first of the ceramic armor element, and the at least one lug on each side of adjacent ceramic armor elements is arranged to be entirely on an opposing half of the sides of the adjacent ceramic armor elements.

3. An armor panel as claimed in claim 2 wherein the at least one lug on each side of the first of the ceramic armor element is not in contact with the lugs on the adjacent ceramic armor elements.

4. An armor panel as claimed in claim 1 wherein at least one of the ceramic armor elements has at least one flat face.

5. An armor panel as claimed in claim 4 wherein the shape of at least one of the ceramic armor elements has a hexagonal transverse cross section.

6. An armor panel as claimed in claim 5 wherein the at least one of the ceramic armor elements when rotated 60° through the axis of symmetry of the hexagonal transverse cross section of that ceramic armor element the position of the lugs on that ceramic armor element is substantially the same.

7. A first and second ceramic armor element, each comprising armor-grade ceramic material and having multiple sides, each side comprising an offset spacing lug that is offset from a longitudinal center-line of the side and integrally moulded as a part of the ceramic armor element, the offset spacing lug of the first ceramic armor element contacting a side of the second ceramic armor element placed adjacently to it but not contacting the spacing lug of the second ceramic armor element in order to provide rotational symmetry and a substantially uniform spacing for a bond line between adjacent sides of the first and second ceramic armor elements, and one or more fixing elements comprising a modified armor element having the same dimensions as the first and second ceramic armor elements but that has a receiving portion to receive a securing component in order to mount an armor panel of a plurality of the first and second ceramic armor elements on an article to be protected.

8. A first ceramic armor element as claimed in claim 7 wherein the offset spacing lug comprises a single lug on each of the multiple sides.

9. A ceramic armor element as claimed in claim 8 wherein the ceramic armor element is moulded.

10. A first ceramic armor element as claimed in claim 9 having at least one flat face.

11. A first ceramic armor element as claimed in claim 10 having a hexagonal transverse cross section.

12. A ceramic first armor element as claimed in claim 11 which, when rotated 60° through the axis of symmetry of the hexagonal transverse cross, the position of the lugs thereon is substantially the same.

13. An armor panel comprising:

a. a first ceramic armor element comprising (i) an upper face, (ii) a lower face, (iii) a side joining the upper and lower faces and defining left-hand and right-hand longitudinal halves, and (iv) a single lug integrally moulded as a part of the ceramic armor element and projecting from one of the left-hand or the right-hand halves of the side; and (b) a second ceramic armor element comprising (i) an upper face, (ii) a lower face, (iii) a side joining the upper and lower faces and defining left-hand and right-hand longitudinal halves, and (iv) a lug integrally moulded as a part of the ceramic armor element and projecting from one of the left-hand or the right-hand halves of the side; and in which (i) the side of the first ceramic armor element is adjacent the side of the second ceramic armor element in use, and (ii) the lug of the first ceramic armor element contacts the side of the second ceramic armor element but not the lug of the second ceramic armor element, thereby providing a substantially uniform space between the adjacent sides of the first and second ceramic armor elements; and (c) one or more fixing elements that mount the armor panel on an article to be protected.

14. An armor panel according to claim 13 in which the first and second ceramic armor elements comprise armor-grade ceramic material.

15. An armor panel according to claim 14 further comprising bonding material in at least part of the substantially uniform space.

16. An armor panel as claimed in claim 1, wherein each side has a longitudinal center line extending between the two opposed faces defining a left-hand side and a right-hand side, and wherein the at least one lug projecting from the side is offset from the center line.

17. A method of protecting against projectile attack, comprising:

(a) providing an armor panel comprising a tessellated array of moulded ceramic armor elements with spacing elements, and one or more fixing elements, wherein (i) each ceramic armor element comprises two substantially opposed faces and at least three sides, (ii) the spacing elements comprise a single lug per side, wherein each lug is integrally molded as a part of the ceramic armor element and offset from a longitudinal center-line of the side to provide minimal contact with sides of adjacent ceramic armor elements in the array in order to define substantially uniform spacing for a bond line between the sides of adjacent ceramic armor elements while minimizing the potential for propagation of energy to adjacent armor elements, and (b) mounting the armor panel externally on an article to be protected via the one or more fixing elements.

18. The method of claim 17, wherein the one or more fixing elements comprise a modified armor element that receives a securing component in order to mount an armor panel comprised of a plurality of the first and second ceramic armor elements on an article to be protected.

19. The armor panel of claim 1, wherein the fixing element comprises a steel element.

* * * * *